US010016989B1

(12) United States Patent
Sugimoto

(10) Patent No.: US 10,016,989 B1
(45) Date of Patent: Jul. 10, 2018

(54) PRINTING APPARATUS

(71) Applicant: Brother Kogyo Kabushiki Kaisha, Nagoya-shi, Aichi-ken (JP)

(72) Inventor: Kiyoshi Sugimoto, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/712,209

(22) Filed: Sep. 22, 2017

(30) Foreign Application Priority Data

Mar. 30, 2017 (JP) ..... 2017-068443

(51) Int. Cl.
*B41J 11/70* (2006.01)
*B41J 11/58* (2006.01)
*B41J 2/32* (2006.01)

(52) U.S. Cl.
CPC ..... *B41J 11/70* (2013.01); *B41J 2/32* (2013.01); *B41J 11/58* (2013.01)

(58) Field of Classification Search
CPC .... B26D 1/06; B26D 2001/0066; B26D 3/08; B26D 3/085; B41J 11/70
See application file for complete search history.

(56) References Cited

U.S. PATENT DOCUMENTS 9,566,805 B2 * 2/2017 Kano ..... B26D 1/065
2016/0288541 A1 10/2016 Kano et al.
2018/0001500 A1 * 1/2018 Tokuda ..... B26D 1/38

FOREIGN PATENT DOCUMENTS

JP 2016-190290 A 11/2016

* cited by examiner

*Primary Examiner* — Huan Tran
(74) *Attorney, Agent, or Firm* — Banner & Witcoff, Ltd.

(57) ABSTRACT

A printing apparatus includes: a conveying unit; a printing unit; a disposing stand provided on a downstream side of the printing unit in a first direction, the disposing stand having a disposing section where a printing medium is disposed; a cutting blade that cuts the printing medium disposed in the disposing section; and a supporting member that supports the cutting blade movably from a non-cutting position, via a partial cut position, to a full cut position. The non-cutting position is a position where a blade edge is separated from the printing medium disposed in the disposing section. The partial cut position is a position where the cutting blade cuts a part of the printing medium in a second direction. The full cut position is a position where a blade edge passes beyond the disposing section to fully cut the printing medium in the second direction.

10 Claims, 12 Drawing Sheets

PRINTING APPARATUS

CROSS REFERENCE TO RELATED APPLICATION

The present application claims priority from Japanese Patent Application No. 2017-068443, filed on Mar. 30, 2017, the disclosure of which is incorporated herein by reference in its entirety.

BACKGROUND

Field of the Invention

The present invention relates to a printing apparatus.

Description of the Related Art

Conventionally, there is known a printing apparatus that executes a cutting operation on a printing medium by means of a disposing stand where the printing medium is disposed and a blade facing the disposing stand. The cutting operation includes a partial cut and a full cut. The partial cut is an operation of the printing apparatus that partially cuts the printing medium in a thickness direction thereof in a state that the printing medium is sandwiched between the blade and the disposing stand. The full cut is an operation of the printing apparatus that fully cuts the printing medium in the thickness direction in the state that the printing medium is sandwiched between the blade and the disposing stand. For example, a conventional printing apparatus includes a printing head, a disposing stand, and a cutting blade. The printing head executes printing on a tube which is an example of the printing medium. The disposing stand and the cutting blade are both provided on a downstream side of the printing head in a conveyance direction of the tube. The cutting operation is executed in a state where the tube is sandwiched between the disposing stand and the cutting blade. The disposing stand moves between a first facing position and a second facing position along the conveyance direction of the tube. When the disposing stand is in the first facing position, the tube sandwiched between the cutting blade and the disposing stand undergoes the partial cut. When the disposing stand is in the second facing position, the tube sandwiched between the cutting blade and the disposing stand undergoes the full cut.

SUMMARY

However, the above-described conventional printing apparatus needs to secure a space for the disposing stand to move in the conveyance direction. Therefore, a position where the tube is cut is separated from the printing head, and an end portion of the tube, that will be a margin without being printed on, lengthens. Thus, there has been a possibility that it becomes difficult to print on the tube without waste of the tube.

An object of the present teaching is to provide a printing apparatus which is capable of cutting a printing medium and which can shorten a margin of the printing medium.

According to an aspect of the present teaching, there is provided a printing apparatus including: a conveying unit configured to convey a printing medium in a first direction; a printing unit configured to execute printing on the printing medium conveyed by the conveying unit; a disposing stand provided on a downstream side of the printing unit in the first direction, the disposing stand having a disposing section where the printing medium is disposed; a cutting blade configured to cut the printing medium disposed in the disposing section, wherein the disposing stand is movable between a first position and a second position different from the first position, in a third direction orthogonal to the first direction and orthogonal to a second direction, the second direction being a thickness direction of the printing medium that is disposed in the disposing section. The printing apparatus according to the aspect of the present teaching may further include a supporting member configured to support the cutting blade movably from a non-cutting position, via a partial cut position, to a full cut position, the non-cutting position being a position at which a blade edge is separated from the printing medium disposed in the disposing section, the partial cut position being a position at which the cutting blade cuts a part of the printing medium in the second direction, the full cut position being a position at which a blade edge passes beyond the disposing section to fully cut the printing medium in the second direction.

Due to the above-described configuration, since a movement direction of the disposing stand is orthogonal to the first direction and the second direction, a margin of the printing medium disposed between the printing unit and the disposing stand shortens. There is hence achieved a printing apparatus which is capable of cutting a printing medium and which can shorten a margin of the printing medium.

DESCRIPTION OF THE EMBODIMENTS

Figure 1:
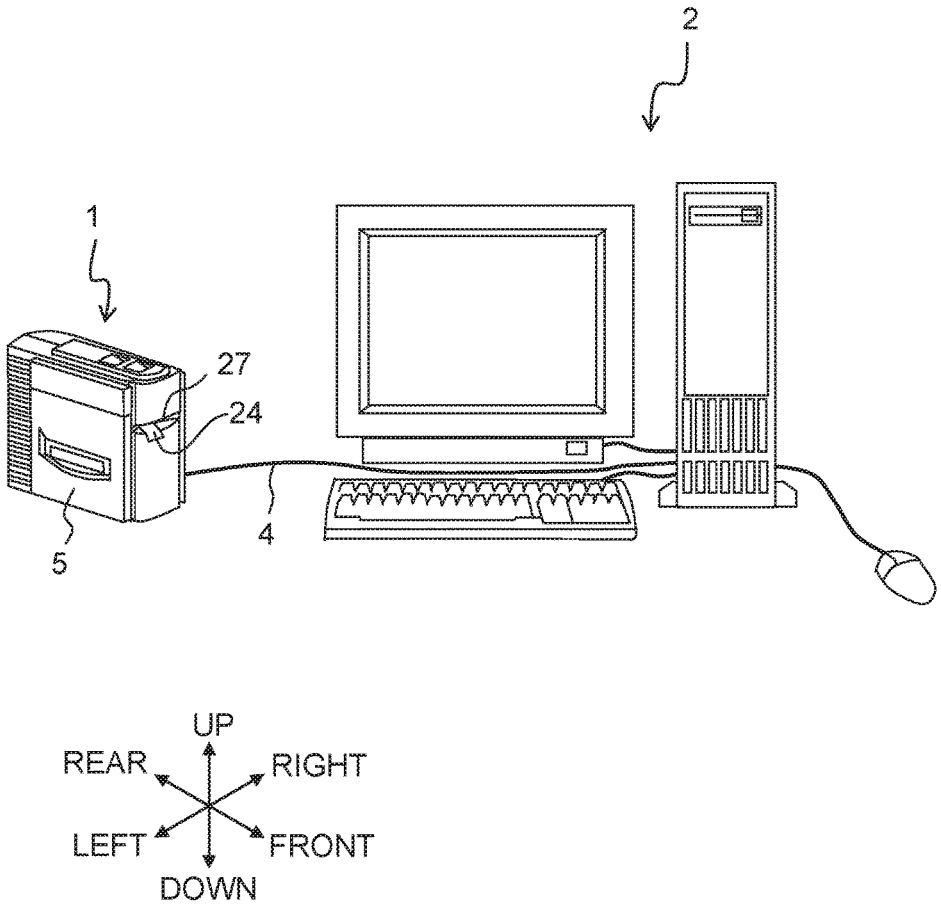
FIG. 1 is a perspective view of a printing apparatus.

A printing apparatus 1 which is an example of an embodiment of the present teaching will be described with reference to the drawings. Hereafter, description will be made assuming that left-right, front-rear, and up-down depicted by arrows in the drawings are left-right, front-rear, and up-down of the printing apparatus 1.

The printing apparatus 1 depicted in FIG. 1 is an apparatus that prints on a printing medium a character such as a letter, a graphic, a symbol, etc. The printing apparatus 1 is an apparatus connected to a data creating apparatus 2 via a connecting member 4. The data creating apparatus 2 operates according to operation of a user. The data creating apparatus 2 creates character data which is data depicting a character and sends the created character data to the printing apparatus 1. Furthermore, the data creating apparatus 2 sends to the printing apparatus 1 a printing instruction to print the character on the printing medium and a cutting instruction to cut the printing-completed printing medium. Cutting of the printing medium in the present embodiment includes a partial cut and a full cut. The partial cut is where part in a thickness direction of the printing medium is cut. The full cut is where all in the thickness direction of the printing medium is cut. Although details thereof will be mentioned later, the printing medium of the present embodiment is a laminated tape 24 that includes a surface layer tape 8 and a double-sided adhesive tape 13 (refer to FIG. 2).

Figure 2:
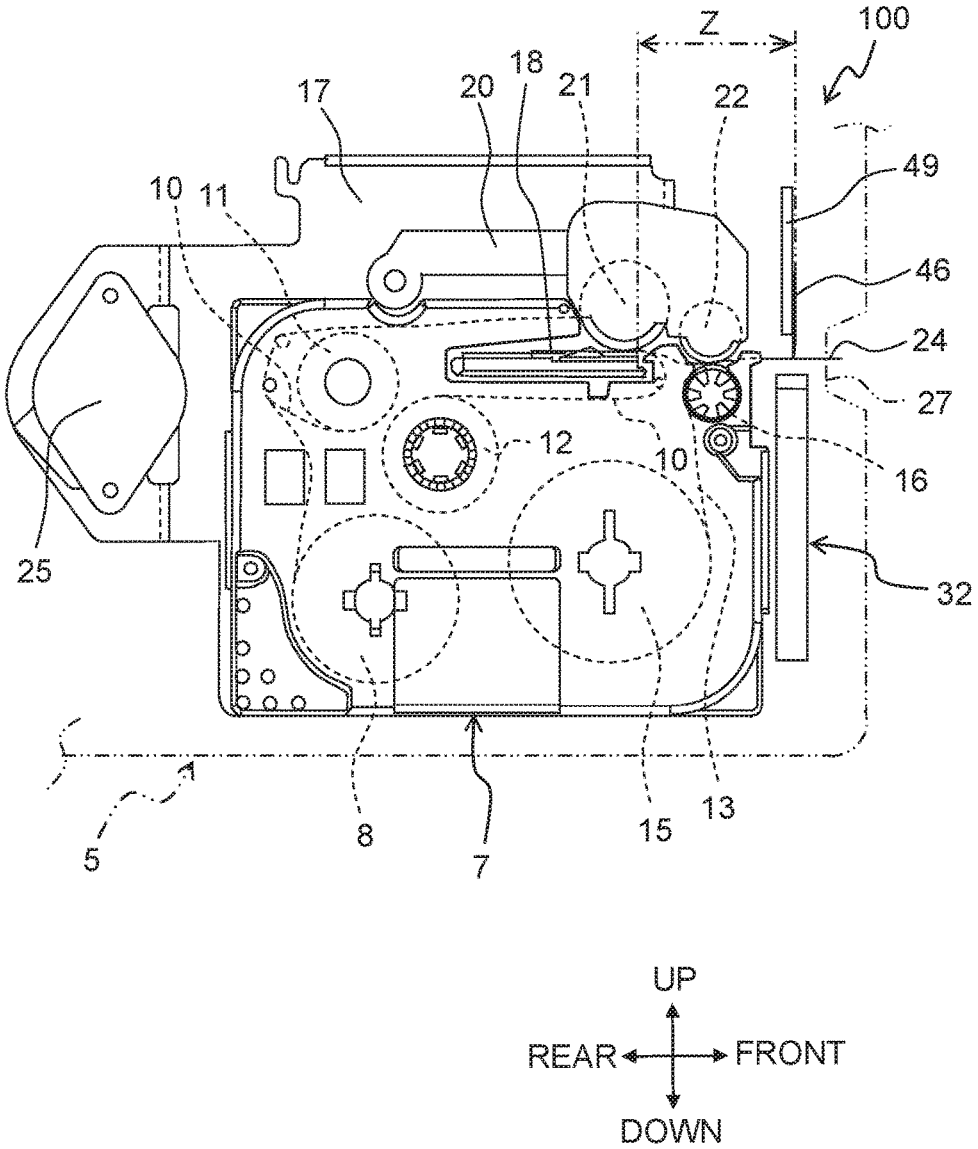
FIG. 2 is a left side view of the printing apparatus.

An internal structure of the printing apparatus 1 will be described with reference to FIG. 2. The printing apparatus 1 includes a case 5. A storage section 17 into/from which a tape cassette 7 can be inserted/removed along a left-right direction, is provided on an inside of the case 5. A tape spool, a ribbon supply spool 11, a take-up spool 12, a base material supply spool 15, and a joining roller 16 are provided on an inside of the tape cassette 7. The surface layer tape 8 which is transparent and of the likes of a PET film, is wound around the tape spool. An ink ribbon 10 is wound around the ribbon supply spool 11. The take-up spool 12 takes up the ink ribbon 10. The double-sided adhesive tape 13 is wound around the base material supply spool 15. The double-sided adhesive tape 13 includes: an adhesive tape having an adhesive agent layer on both sides thereof; and a peel-off tape affixed to an outer side of the double-sided adhesive tape. The joining roller 16 is provided rotatably.

A thermal head 18 and a roller holder 20 are provided in the storage section 17. The thermal head 18 includes a plurality of heating elements and is plate-like. A platen roller 21 and a feeding roller 22 are provided rotatably in the roller holder 20. The platen roller 21 sandwiches the ink ribbon 10 and the surface layer tape 8 between itself and the thermal head 18. The feeding roller 22 sandwiches the surface layer tape 8 and the double-sided adhesive tape 13 between itself and the joining roller 16. The sandwiched surface layer tape 8 and double-sided adhesive tape 13 (hereafter, called the laminated tape 24) are able to pass through a discharge port 27 provided in the case 5. The take-up spool 12, the feeding roller 22, and the joining roller 16 are coupled to a drive motor 25 provided on the inside of the case 5. Therefore, the feeding roller 22 cooperating with the joining roller 16 can convey the laminated tape 24. Hereafter, an orientation that the laminated tape 24 is conveyed between the feeding roller 22 and the discharge port 27 will be called a conveyance direction (an exemplary "first direction" of the present teaching). The conveyance direction of the present embodiment substantially matches a front-rear direction. A thickness direction of the laminated tape 24 conveyed between the feeding roller 22 and the discharge port 27 matches an up-down direction, and a width direction of the laminated tape 24 matches the left-right direction.

A cutting apparatus 100 will be described with reference to FIGS. 3 and 4. The cutting apparatus 100 is an apparatus that makes a partial cut or a full cut of the laminated tape 24. The cutting apparatus 100 is provided at a position between the feeding roller 22 and the discharge port 27, in the conveyance direction (refer to FIG. 2). In other words, the cutting apparatus 100 is provided on a downstream side of the thermal head 18 in the conveyance direction. The cutting apparatus 100 includes a disposing mechanism 70 and a movable mechanism 80.

The disposing mechanism 70 is a mechanism by which the laminated tape 24 is disposed. The laminated tape 24 is disposed in a posture that its thickness direction will be the up-down direction. The disposing mechanism 70 includes a disposing stand 32, a rotating body 71, and a disposing stand motor 75. The disposing stand 32 includes a supporting section 33, a disposing section 34, a groove 39, a first contact part 37, and a second contact part 38. The supporting section 33 is provided movably in the left-right direction. In more detail, the supporting section 33 is supported movably in the left-right direction by means of a rail 35 extending in the left-right direction fixed to the inside of the case 5 (refer to FIG. 2). A long hole 31 which is long in the up-down direction is provided in the supporting section 33. The disposing section 34 of the present embodiment is a plane surface forming part of an upper end surface of the supporting section 33. A peel-off paper of the double-sided adhesive tape 13 forming the laminated tape 24 is disposed on the disposing section 34. The disposing section 34 and the peel-off paper face each other in the up-down direction. The groove 39 is provided on an upper end surface of the disposing section 34 and recesses downwardly. The groove 39 extends linearly in the left-right direction. A dimension in the conveyance direction of the groove 39 is a groove width and corresponds to dimension W1 (refer to FIG. 4). The first contact part 37 forms the upper end surface of the supporting section 33 more to a left side than the disposing section 34. As an example, a position in the up-down direction of the first contact part 37 is the same as that of the disposing section 34. The second contact part 38 is a plane surface forming the upper end surface of the supporting section 33 more to a left side than the first contact part 37, and is formed more downwardly than the first contact part 37. A distance in the up-down direction between the first contact part 37 and the second contact part 38 (corresponding to dimension D of FIG. 3) is longer than a thickness of the double-sided adhesive tape 13 forming the laminated tape 24 (refer to FIG. 4).

Figure 5:
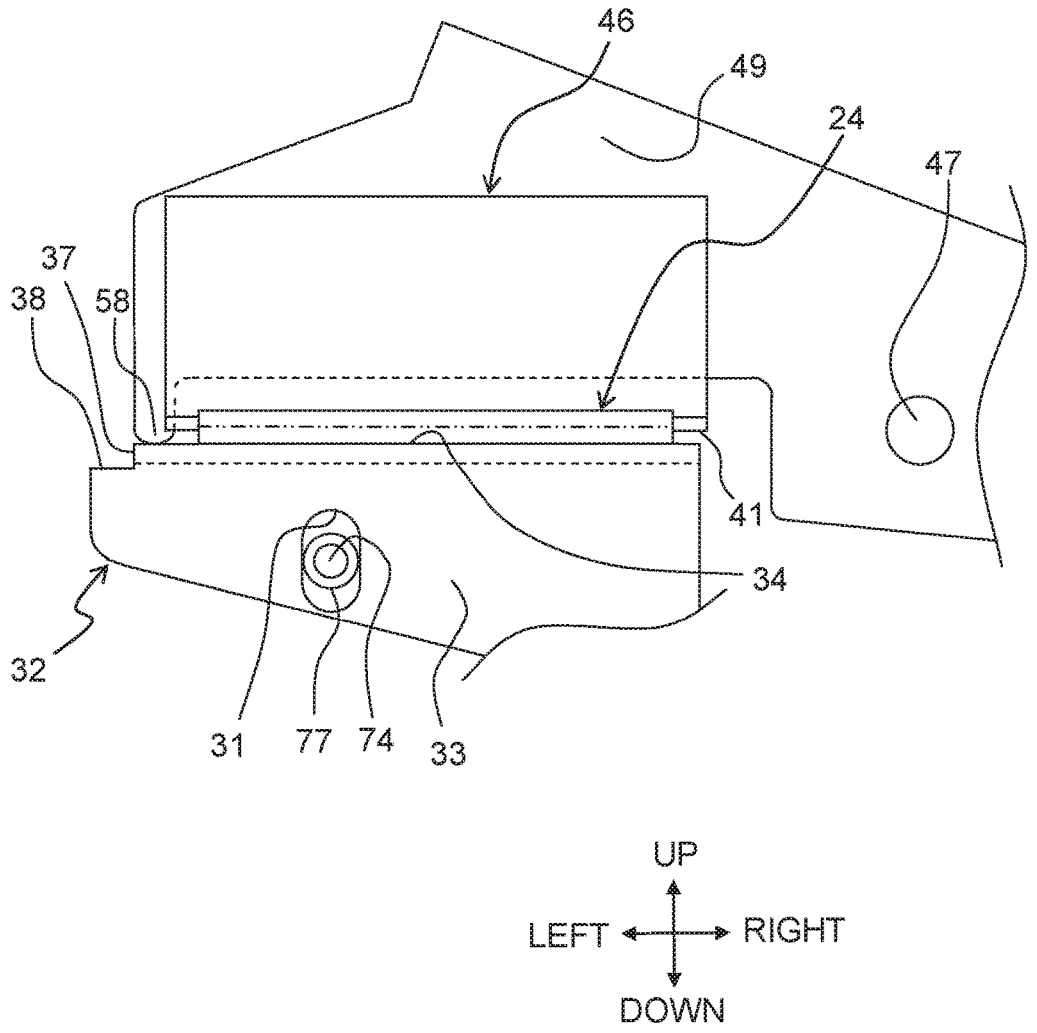
FIG. 5 is a front view of the cutting apparatus where the cutting blade is positioned in a partial cut position.

The rotating body 71 is provided rotatably with the conveyance direction as its axial direction. The rotating body 71 has a pin 74 that lies along the conveyance direction. The pin 74 is inserted in the long hole 31. The pin 74 rotatably supports a roller 77. The roller 77 fits slidably in the long hole 31. The rotating body 71 is coupled to the disposing stand motor 75 via a gear 72. The disposing stand motor 75 is a motor capable of forward and reverse rotation. When the rotating body 71 rotates due to drive of the disposing stand motor 75, the pin 74 moves the disposing stand 32 in the left-right direction via the roller 77. The disposing stand 32 moves in the left-right direction (an exemplary "third direction" of the present teaching) between a first position (refer to FIGS. 3 and 5) and a second position (refer to FIG. 7). When the cutting apparatus 100 executes the partial cut, the disposing stand 32 is positioned at the first position. When the cutting apparatus 100 executes the full cut, the disposing stand 32 is positioned at the second position.

Figure 3:
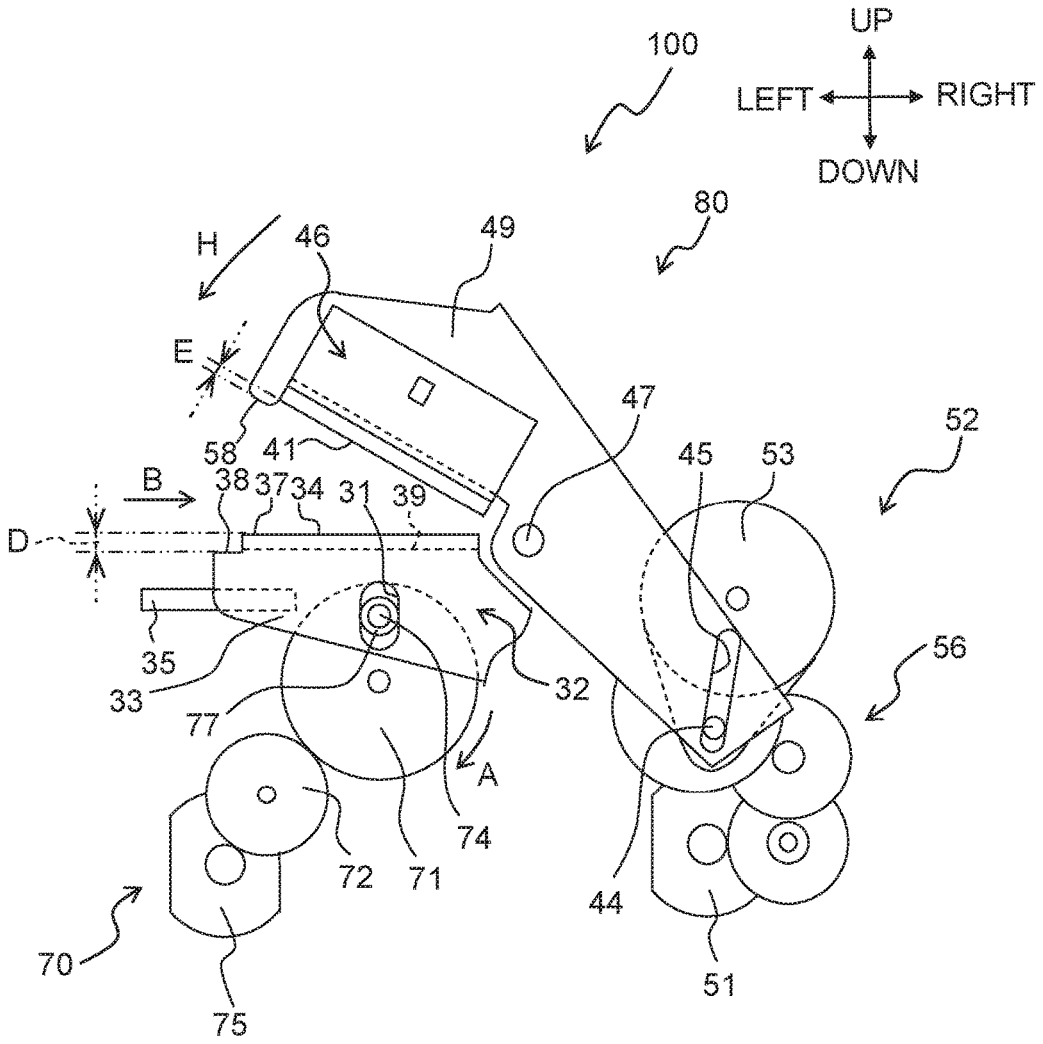
FIG. 3 is a front view of a cutting apparatus where a cutting blade is positioned in a non-cutting position.
Figure 4:
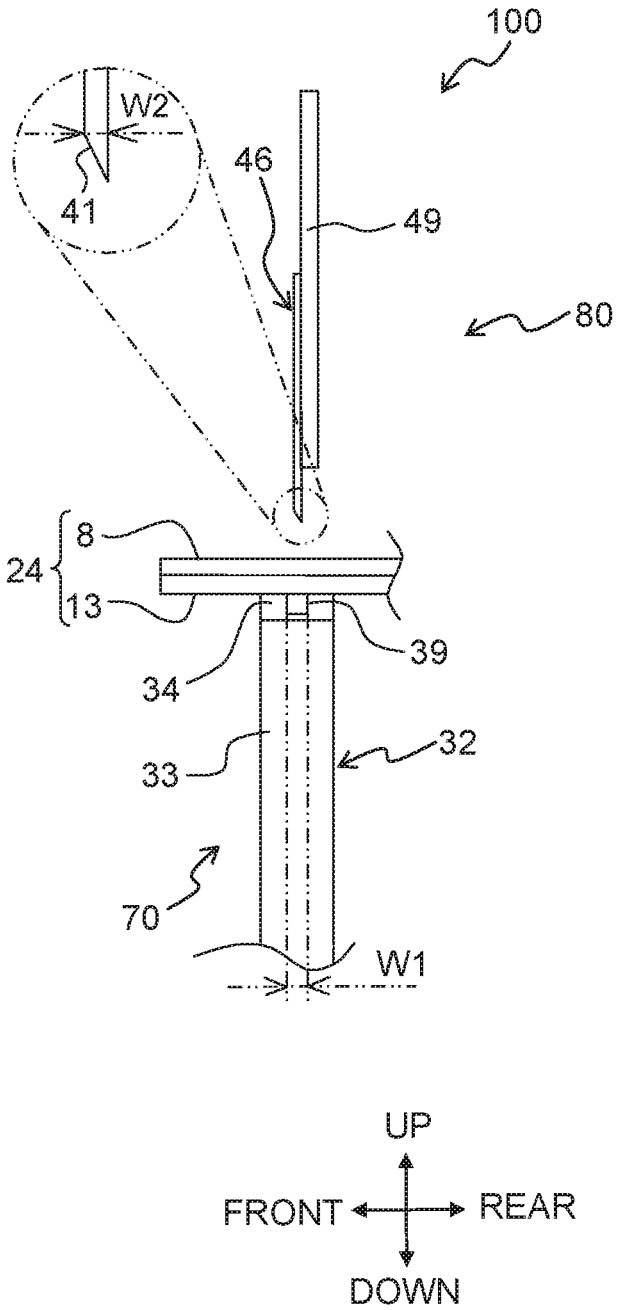
FIG. 4 is a right side view of the cutting apparatus where the cutting blade is positioned in the non-cutting position.

The movable mechanism 80 depicted in FIG. 3 is a mechanism that cooperates with the disposing mechanism 70 to make the partial cut or the full cut of the laminated tape 24. The movable mechanism 80 includes a shaft section 47, a supporting member 49, a cutting blade 46, a projecting section 58, and a power transmission section 52. The shaft section 47 is fixed to the inside of the case 5 (refer to FIG. 2) in a posture that its axial direction will be the conveyance direction. The shaft section 47 is a rotation center of the supporting member 49 and rotatably supports the supporting member 49. A long hole 45 is provided in the supporting member 49. The supporting member 49 supports the cutting blade 46. The cutting blade 46 is formed by a metal material and is plate-like, as an example. The cutting blade 46 has a blade edge 41 which is a region that has undergone blade edging. In the blade edge 41 of the present embodiment, only a front end, of the front end and a rear end of the cutting blade 46 undergoes blade edging (refer to FIG. 4). The blade edge 41 extends linearly facing the disposing section 34 and is capable of entering the groove 39. The projecting section 58 is part of the supporting member 49. The projecting section 58 projects more toward a disposing section 34 side than the blade edge 41, along a direction circumferential with reference to the shaft section 47. A projection amount with respect to the blade edge 41 of the projecting section 58 (corresponding to dimension E) is greater than zero and less than or equal to a thickness of the double-sided adhesive tape 13. The projecting section 58 selectively contacts the first contact part 37 and the second contact part 38 depending on movement of the disposing stand 32 in the left-right direction.

Figure 6:
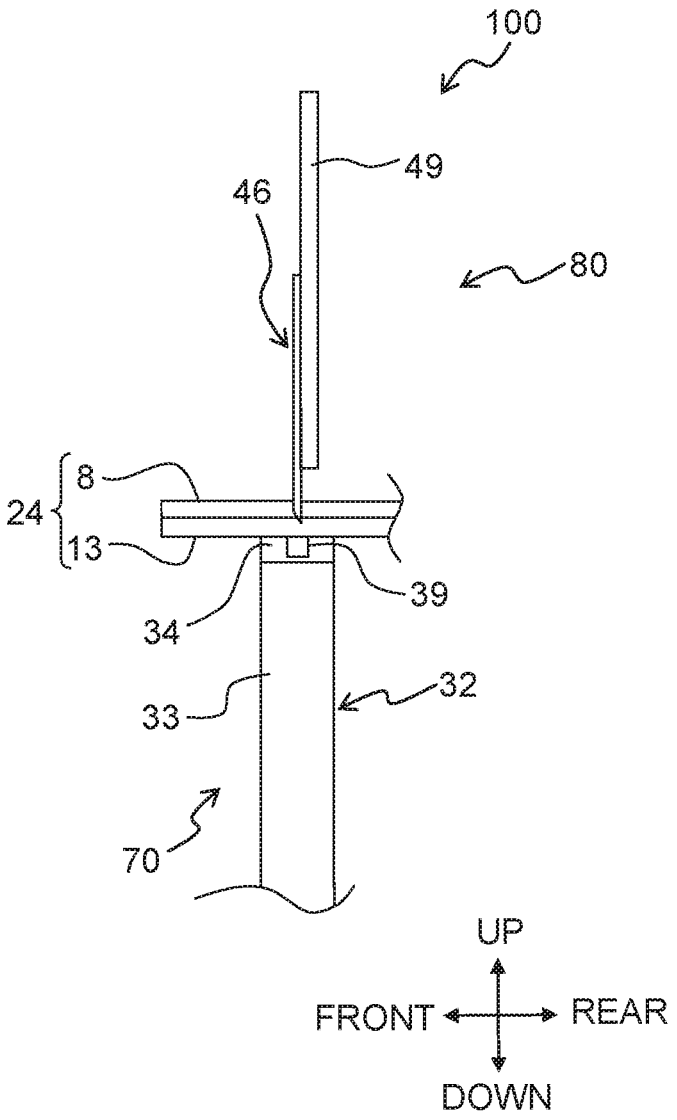
FIG. 6 is a right side view of the cutting apparatus where the cutting blade is positioned in the partial cut position.

The power transmission section 52 includes a rotating body 53 and a cutting motor 51. The rotating body 53 is rotatable with the conveyance direction as its axial direction. A pin 44 that lies along the front-rear direction is provided in the rotating body 53, and the pin 44 fits slidably in the long hole 45 of the supporting member 49. The cutting motor 51 is a motor capable of forward and reverse rotation that is coupled to the rotating body 53 via a gear train 56. Therefore, when the rotating body 53 rotates with drive of the cutting motor 51, the pin 44 pivots the cutting blade 46 via the supporting member 49. The cutting blade 46 is pivotable between a non-cutting position (refer to FIG. 3) and a full cut position (refer to FIGS. 7 and 8), via a partial cut position (refer to FIGS. 5 and 6). When the cutting blade 46 is positioned in the non-cutting position, the blade edge 41 is separated on an opposite side to the disposing section 34, from the laminated tape 24 disposed in the disposing section 34. When the cutting blade 46 is positioned in the full cut position, the blade edge 41 enters the groove 39. When the cutting blade 46 is positioned in the full cut position, all of the blade edge 41 facing the laminated tape 24 is disposed more downwardly than the disposing section 34, with a minute gap from the disposing section 34. In other words, in the full cut position, a direction that the blade edge 41 extends is not orthogonal to the thickness direction of the laminated tape 24 disposed in the disposing section 34 (an exemplary "second direction" of the present teaching). Magnitude of the minute gap depends on the projection amount with respect to the blade edge 41 of the projecting section 58 (refer to dimension E of FIG. 3).

A relationship between the groove width of the groove 39 (dimension W1) and a blade width of the cutting blade 46 (dimension W2) will be described with reference to FIG. 4. The blade width of the cutting blade 46 is a maximum length in the conveyance direction of the blade edge 41 entering the groove 39. The groove width of the groove 39 is shorter than five times the blade width, is preferably shorter than two times the blade width, and is even more preferably shorter than 1.5 times the blade width. The groove width of the groove 39 in the present embodiment is shorter than 1.5 times the blade width. The groove 39 has a depth such that a bottom surface of the groove 39 will be more downward than the blade edge 41 of the cutting blade 46 in the full cut position.

An outline of a printing operation due to the printing apparatus 1 will be described with reference to FIG. 2. The drive motor 25 rotates, whereby the take-up spool 12, the feeding roller 22, and the joining roller 16 rotate synchronously with each other. At the same time, the thermal head 18 selectively electrically drives the plurality of heating elements to heat the heating elements. Ink included in the ink ribbon 10 is transferred to the surface layer tape 8 by generated heat of the heating elements, whereby printing is executed. The surface layer tape 8 on which printing has been executed is conveyed by rotation of the feeding roller 22 and the joining roller 16 and by following rotation of the platen roller 21. The surface layer tape 8 on which printing has been executed is laminated on the double-sided adhesive tape 13 between the feeding roller 22 and the joining roller 16, thereby generating the printing-completed laminated tape 24. Subsequently, the laminated tape 24 is conveyed toward the cutting apparatus 100.

An operation in which the cutting apparatus 100 executes the partial cut will be described with reference to FIGS. 3 to 6. The cutting blade 46 is in the non-cutting position, and the disposing stand 32 is in the first position (refer to FIG. 3). In this case, the projecting section 58 faces the first contact part 37 along a pivoting direction of the cutting blade 46. The rotating body 53 rotates with drive of the cutting motor 51, whereby the cutting blade 46 that had been in the non-cutting position pivots toward the disposing stand 32 around the shaft section 47 (arrow H of FIG. 3). A region adjacent to the shaft section 47 of the blade edge 41 precedes a region separated from the shaft section 47 of the blade edge 41 to sandwich the laminated tape 24 between itself and the disposing section 34. A cut begins to be made in a region on a shaft section 47 side of the surface layer tape 8 configuring the laminated tape 24. The cutting blade 46 further pivots, whereby the blade edge 41 makes a cut in the surface layer tape 8 configuring the laminated tape 24 over a radial direction centered on the shaft section 47. Subsequently, the projecting section 58 contacts the first contact part 37, whereby the cutting blade 46 is held (positioned) (refer to FIGS. 5 and 6). The cutting motor 51 stops drive. At this time, the blade edge 41 extends linearly in the left-right direction at the same height position as a shaft center of the shaft section 47, and is positioned more upwardly than the disposing section 34. In the partial cut position, the direction that the blade edge 41 extends (left-right direction) is orthogonal to the thickness direction of the laminated tape 24 disposed in the disposing section 34 (up-down direction). The blade edge 41, while cutting the surface layer tape 8, does not cut the double-sided adhesive tape 13. As a result, the laminated tape 24 undergoes the partial cut.

Figure 7:
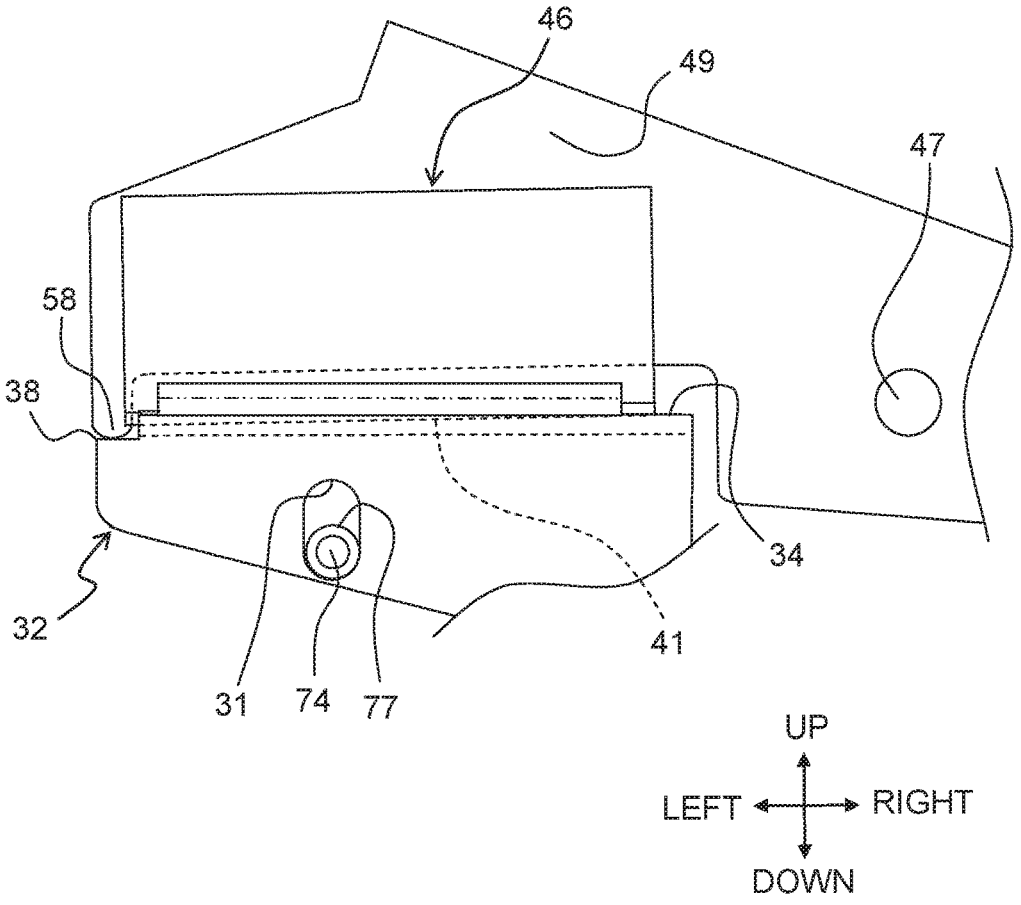
FIG. 7 is a front view of the cutting apparatus where the cutting blade is positioned in a full cut position.
Figure 8:
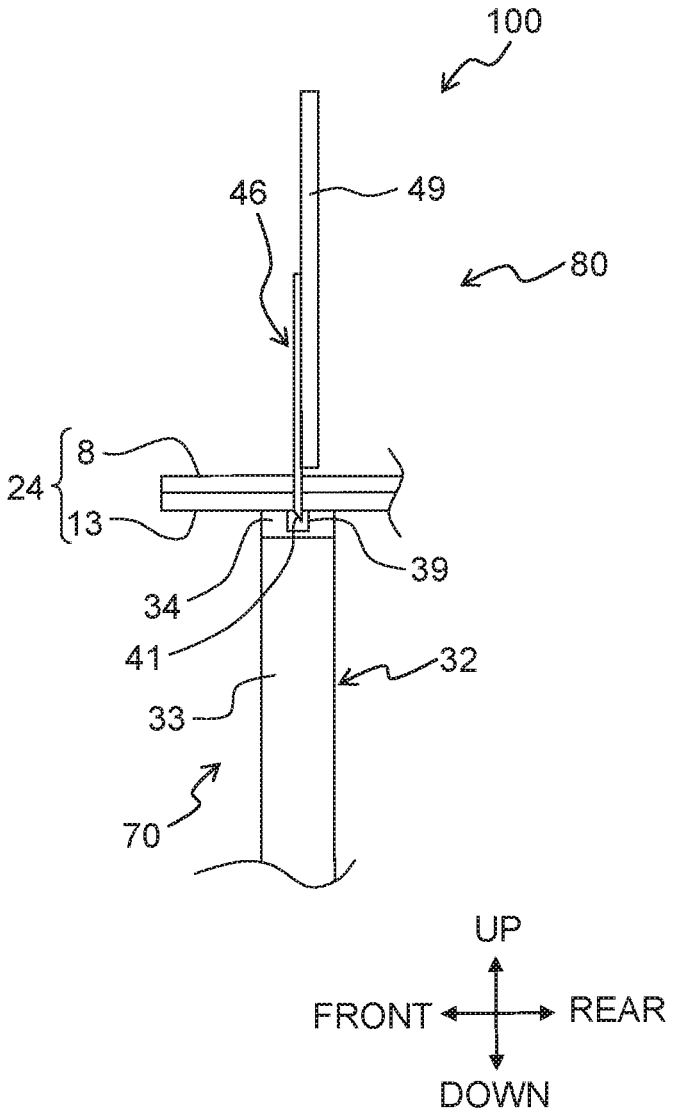
FIG. 8 is a right side view of the cutting apparatus where the cutting blade is positioned in the full cut position.

An operation in which the cutting apparatus 100 executes the full cut will be described with reference to FIGS. 3, 7, and 8. The cutting blade 46 is in the non-cutting position, and the disposing stand 32 is in the first position (refer to FIG. 3). As depicted in FIG. 3, the disposing stand motor 75 is driven, whereby the rotating body 71 rotates clockwise in front view (arrow A) and the roller 77 undergoes displacement to a right side while sliding along the long hole 31. As a result, the disposing stand 32 that had been in the first position moves rightwards (arrow B) and reaches the second position (refer to FIG. 7). The cutting motor 51 is driven similarly to during the partial cut, whereby the cutting blade 46 pivots toward the disposing section 34 (arrow H of FIG. 3). The blade edge 41 begins to make a cut in order from a region on the shaft section 47 side of the laminated tape 24. The first contact part 37 allows the cutting blade 46 to move as far as the full cut position, without the first contact part 37 contacting either the supporting member 49 or the cutting blade 46. When the projecting section 58 has contacted the second contact part 38, the cutting blade 46 reaches the full cut position. At this time, the cutting blade 46 severs the laminated tape 24 with the blade edge 41 as a boundary. All of the double-sided adhesive tape 13 is cut. All of the blade edge 41 that had been facing the laminated tape 24 passes through the disposing section 34 to enter into the groove 39. As depicted in FIG. 7, the blade edge 41 extends linearly inclined from an upper right side to a lower left side, more to an upper side than the bottom surface of the groove 39. The cutting motor 51 stops drive, and the cutting apparatus 100 finishes a full cut operation.

As described above, the cutting apparatus 100 makes the partial cut or the full cut of the laminated tape 24. At a start time of the printing operation of the printing apparatus 1, a region of the laminated tape 24 disposed between the thermal head 18 and the disposing stand 32 is a margin not printed with a character. In the present embodiment, the disposing stand 32 moves in the left-right direction according to whether the cutting apparatus 100 makes the partial cut or makes the full cut. That is, a movement direction of the disposing stand 32 is a direction orthogonal to the thickness direction of the laminated tape 24 and the conveyance direction. A distance along the conveyance direction between the thermal head 18 and the disposing stand 32 (corresponding to dimension Z of FIG. 2) shortens proportionately to the disposing stand 32 not moving along the conveyance direction. Therefore, the margin of the laminated tape 24 shortens. As a result, the printing apparatus 1 can execute printing of little waste on the laminated tape 24. There is hence achieved the printing apparatus 1 which is capable of cutting the laminated tape 24 and which can shorten the margin of the laminated tape 24.

When the disposing stand 32 is in the second position, the first contact part 37 allows the cutting blade 46 to be positioned in the full cut position, without the first contact part 37 contacting either the supporting member 49 or the cutting blade 46. Since movement of the cutting blade 46 during the full cut is not hindered, the printing apparatus 1 can stabilize the full cut operation.

When the disposing stand 32 is in the second position, the second contact part 38 contacts the projecting section 58, whereby the cutting blade 46 is held (positioned) in the full cut position. As a result, even when the cutting apparatus 100 executes the full cut operation over a plurality of times, it is difficult for the full cut position of the cutting blade 46 to vary. Hence, the cutting apparatus 100 can stabilize the full cut operation.

The projecting section 58 that projects more to a disposing section 34 side than the blade edge 41 contacts the first contact part 37. As a result, since it becomes difficult for the blade edge 41 to contact the disposing section 34, life of the cutting blade 46 can be lengthened. When the cutting apparatus 100 executes the full cut, the blade edge 41 enters into the groove 39. Hence, the printing apparatus 1 can reliably make the full cut of the laminated tape 24. The groove width of the groove 39 is shorter than five times the blade width of the cutting blade 46. The narrower the groove width is with respect to the blade width, the more difficult it is for the laminated tape 24 to enter the groove 39 during execution of the full cut or the partial cut. In other words, during execution of the full cut or the partial cut, it is difficult for the laminated tape 24 to deform downwardly which is a direction of separation of the laminated tape 24 from the blade edge 41. Hence, cutting of the laminated tape 24 can be stabilized.

The cutting blade 46 pivots around the shaft section 47. As a result, the cutting blade 46 executing the partial cut or the full cut makes a cut from the region adjacent to the shaft section 47 of the laminated tape 24. Since the blade edge 41 never contacts the laminated tape 24 substantially simultaneously throughout an extension direction of the blade edge 41, a shearing force that the blade edge 41 applies to the laminated tape 24 can be increased. Hence, the cutting apparatus 100 can stabilize the cutting operation. Moreover, a load applied to the cutting motor 51 decreases as compared to when the blade edge 41 contacts the laminated tape 24 substantially simultaneously throughout the extension direction of the blade edge 41.

In the above description, the laminated tape 24 is an example of the "printing medium" of the present teaching. The thermal head 18 is an example of a "printing unit" of the present teaching. The platen roller 21 and feeding roller 22 are an example of a "conveying unit" of the present teaching.

The present teaching is not limited to the above-described embodiment. The printing medium may be a tube, instead of being the laminated tape 24. In this case, a direction orthogonal to the planar disposing section 34 will be a thickness direction of the tube. Even in this case, a margin of the tube shortens. The disposing section 34 need only be capable of having the laminated tape 24 disposed on it, and is not limited to being planar. For example, the disposing section 34 may be a curved surface, or may be an uneven surface.

The cutting blade 46 may be capable of linear movement along the up-down direction, for example, instead of being rotatable around the shaft section 47. In this case, when the cutting apparatus 100 executes the full cut or the partial cut, the blade edge 41 may contact the laminated tape 24 substantially simultaneously throughout the extension direction of the blade edge 41. Moreover, the blade edge 41 may be a region where both front end and rear end of the cutting blade 46 have undergone blade edging.

Figure 9:
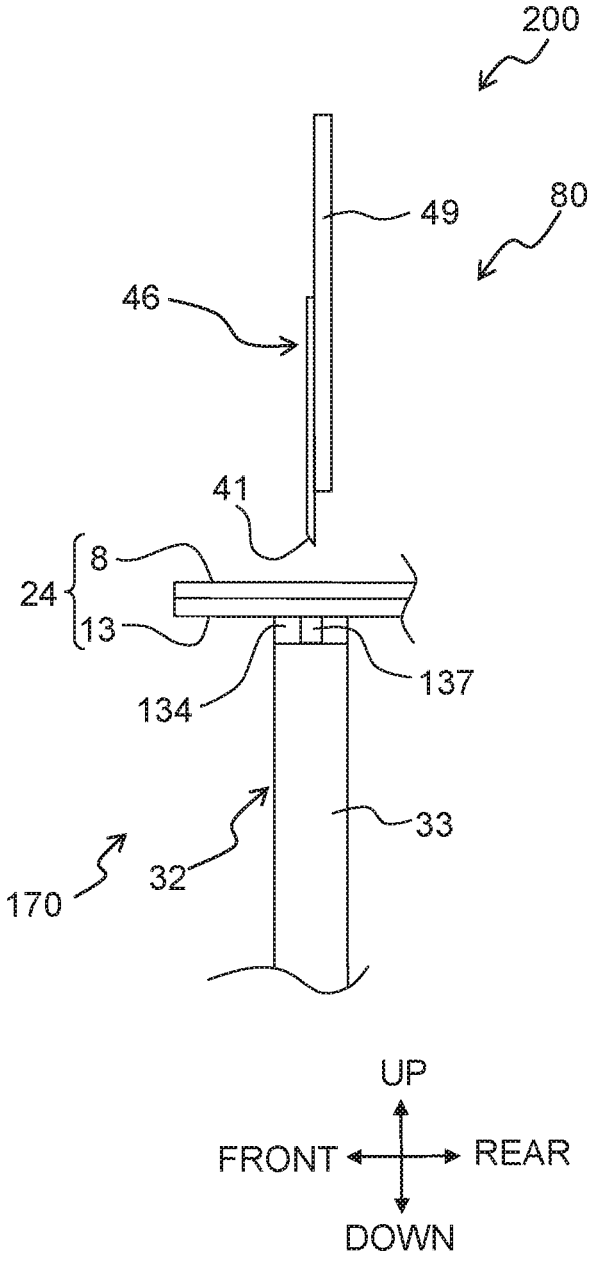
FIG. 9 is a right side view of a cutting apparatus of a first modified example.

A cutting apparatus 200 which is a first modified example of the cutting apparatus 100 (refer to FIG. 3) will be described with reference to FIG. 9. Hereafter, configurations that are the same as in the cutting apparatus 100 will be assigned with the same reference symbols in the drawings as those assigned to the cutting apparatus 100, and detailed descriptions thereof will be omitted. The cutting apparatus 200 includes a disposing mechanism 170 in place of the disposing mechanism 70. The disposing mechanism 170 includes a disposing section 134 in place of the disposing section 34. The disposing section 134 includes a member 137 which is softer than the blade edge 41. The member 137 is fixed embedded in the disposing section 34, as an example. An upper end surface of the member 137 is substantially flush with an upper end surface of the disposing section 134. The member 137 deforms more easily compared to the blade edge 41. Whichever position of the first position (refer to FIG. 3) and the second position (refer to FIG. 7) the disposing stand 32 is in, the member 137 faces the blade edge 41 along the pivoting direction of the cutting blade 46. The member 137 is formed by urethane, as an example.

When the cutting motor 51 is driven in a state where the disposing stand 32 is in the first position, the supporting member 49 pivots to a position that the projecting section 58 and the first contact part 37 contact. The blade edge 41 of the cutting blade 46 stops upwards of the member 137 and makes the partial cut of the laminated tape 24 (refer to FIG. 6). When the partial cut is performed, the member 137 deforms slightly so as to contract.

When the cutting motor 51 is driven in a state where the disposing stand 32 is in the second position, the supporting member 49 pivots to a position that the projecting section 58 and the second contact part 38 contact. The blade edge 41 severs the laminated tape 24 in two, and stops by contacting the member 137. At this time, the member 137 deforms more greatly than during the partial cut, and the blade edge 41 passes beyond the disposing section 134. In the present embodiment, when the cutting blade 46 makes the partial cut or the full cut of the laminated tape 24, the deforming member 137 receives the blade edge 41, so a reaction force transmitted to the blade edge 41 can be reduced. Hence, life of the cutting blade 46 can be lengthened.

Figure 10:
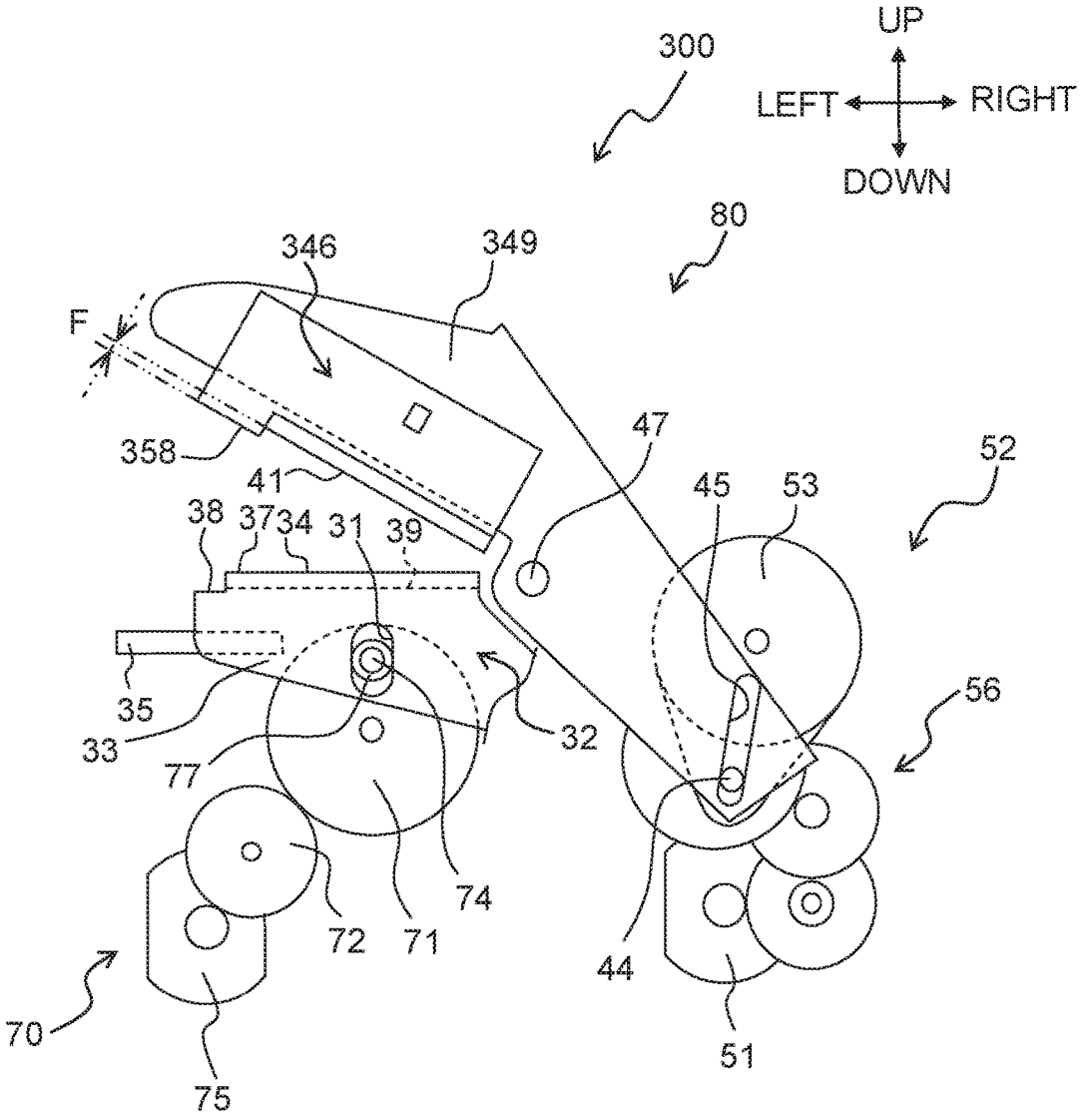
FIG. 10 is a front view of a cutting apparatus of a second modified example.

The projecting section 58 (refer to FIG. 3) need not be provided in the supporting member 49 (refer to FIG. 3). A cutting apparatus 300 which is a second modified example of the cutting apparatus 100 (refer to FIG. 3) will be described below with reference to FIG. 10. Note that configurations that are the same as in the cutting apparatus 100 will be assigned with the same reference symbols in the drawings as those assigned to the cutting apparatus 100, and detailed descriptions thereof will be omitted.

The cutting apparatus 300 includes a supporting member 349 in place of the supporting member 49 (refer to FIG. 3) and includes a cutting blade 346 in place of the cutting blade 46 (refer to FIG. 3). In the cutting apparatus 300, a projecting section 358 is provided in the cutting blade 346, instead of the projecting section 58 being provided in the supporting member 49. A projection amount with respect to the blade edge 41 of the projecting section 358 (dimension F) is the same as the projection amount with respect to the blade edge 41 of the projecting section 58 (dimension E of FIG. 3). When the disposing stand 32 is in the first position (refer to FIG. 10), the projecting section 358 contacts the first contact part 37, whereby the cutting blade 346 is held in the partial cut position. On the other hand, when the disposing stand 32 is in the second position (illustration of which is omitted), the projecting section 358 contacts the second contact part 38, whereby the cutting blade 346 is held in the full cut position.

Figure 11:
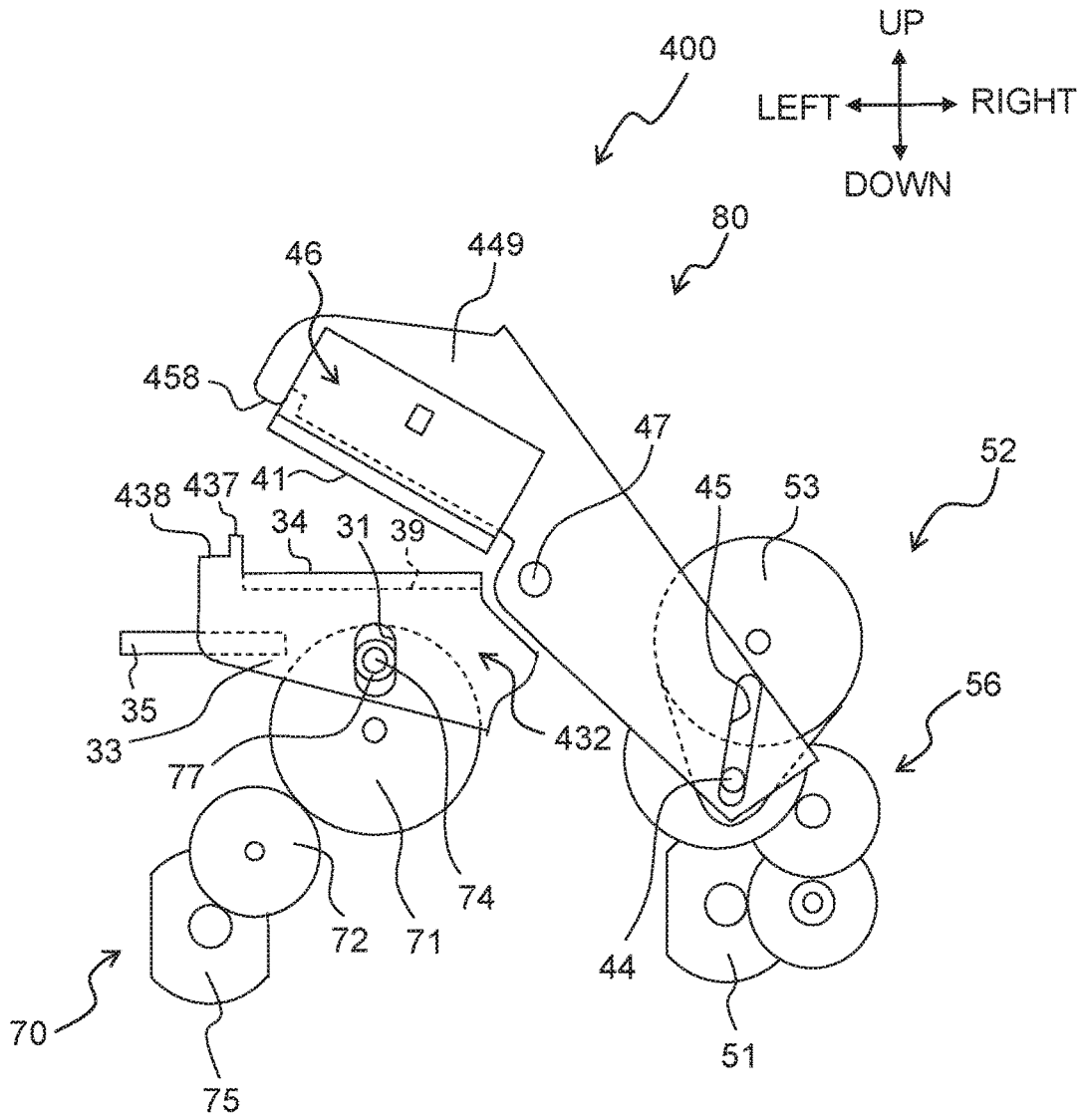
FIG. 11 is a front view of a cutting apparatus of a third modified example.

The first contact part 37 (refer to FIG. 3) need not be formed at the same position as the disposing section 34 in relation to the up-down direction, and the cutting apparatus 100 (refer to FIG. 3) need not include the projecting section 58. A cutting apparatus 400 which is a third modified example of the cutting apparatus 100 (refer to FIG. 3) will be described below with reference to FIG. 11. Note that configurations that are the same as in the cutting apparatus 100 will be assigned with the same reference symbols in the drawings as those assigned to the cutting apparatus 100, and detailed descriptions thereof will be omitted.

The cutting apparatus 400 includes a disposing stand 432 in place of the disposing stand 32 (refer to FIG. 3). The disposing stand 432 is movable in the left-right direction. The disposing stand 432 includes a first contact part 437 and a second contact part 438. The first contact part 437 is positioned more upwardly than the disposing section 34 of the disposing stand 432. The second contact part 438 is positioned at substantially the same height as the disposing section 34. The cutting apparatus 400 includes a supporting member 449 in place of the supporting member 49 (refer to FIG. 3). The supporting member 449 includes an abutting section 458 in place of the projecting section 58 (refer to FIG. 3). The abutting section 458 is positioned more in a direction of clockwise rotation around the shaft section 47 in front view, than the blade edge 41. When the disposing stand 432 is in the first position (refer to FIG. 11), the first contact part 437 faces the abutting section 458 in the up-down direction. The abutting section 458 contacts the first contact part 437, whereby the cutting blade 46 is held in the partial cut position. On the other hand, when the disposing stand 432 is in the second position (illustration of which is omitted), the second contact part 438 faces the abutting section 458 in the up-down direction. The abutting section 458 contacts the second contact part 438, whereby the cutting blade 46 is held in the full cut position.

Note that the second contact part 438, similarly to the first contact part 437, may be positioned more upwardly than the disposing section 34. In this case, the abutting section 458 is positioned even more in the direction of clockwise rotation around the shaft section 47 in front view than the position depicted in FIG. 11, and the first contact part 437 is disposed even more upwardly than the position depicted in FIG. 11.

Figure 12:
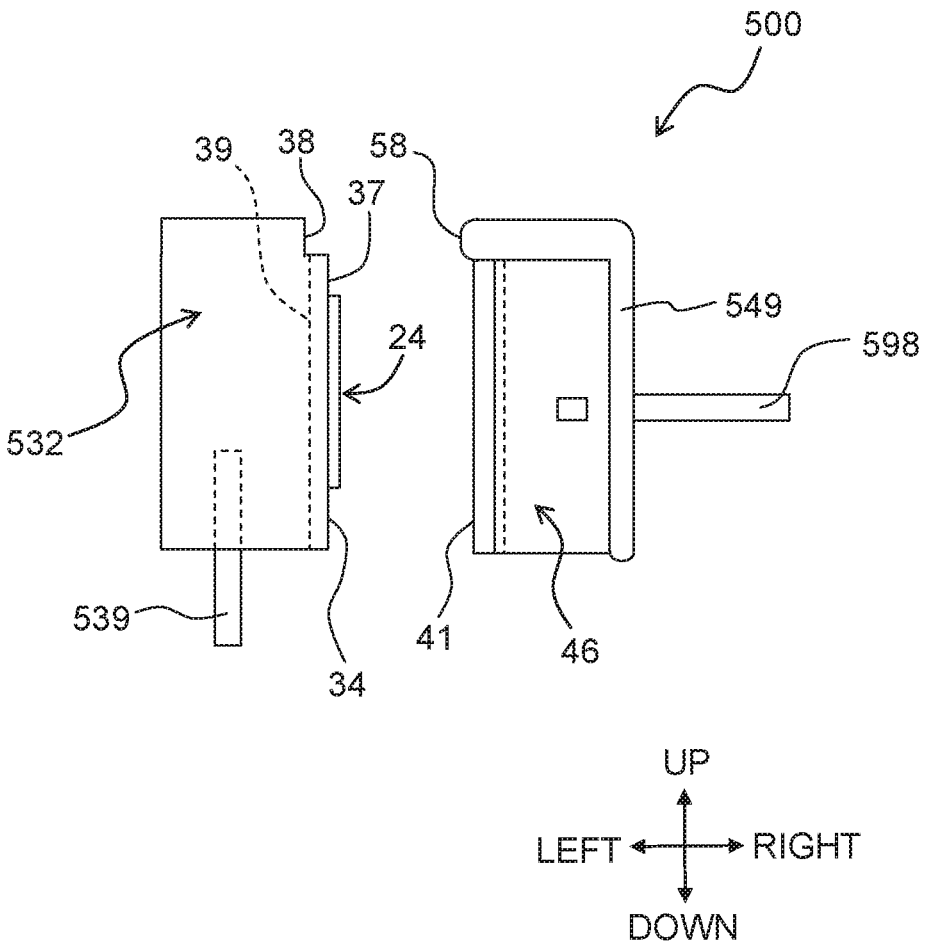
FIG. 12 is a front view of a cutting apparatus of a fourth modified example.

The tape cassette 7 may be capable of being inserted/removed into/from the storage section 17 (refer to FIG. 2) along the up-down direction, for example. In this case, the thickness direction of the laminated tape 24 conveyed between the feeding roller 22 and the discharge port 27 is the left-right direction, and the width direction of the laminated tape 24 will be the up-down direction. A cutting apparatus 500 which is a fourth modified example of the cutting apparatus 100 (refer to FIG. 3) will be described below with reference to FIG. 12. Note that configurations that are the same as in the cutting apparatus 100 will be assigned with the same reference symbols in the drawings as those assigned to the cutting apparatus 100, and detailed descriptions thereof will be omitted. A thickness direction of the laminated tape 24 cut by the cutting apparatus 500 matches the left-right direction, and a width direction of the laminated tape 24 matches the up-down direction.

The cutting apparatus 500 includes a supporting member 549 in place of the supporting member 49. The supporting member 549 is supported movably in the left-right direction, by means of a rail 598 extending in the left-right direction fixed to the inside of the case 5 (refer to FIG. 2). The blade edge 41 of the cutting blade 46 supported by the supporting member 549 forms a left end of the cutting blade 46 and extends in the up-down direction. Part of the supporting member 549 is the projecting section 58. The projecting section 58 projects more leftwards than the blade edge 41.

The cutting apparatus 500 includes a disposing stand 532 in place of the disposing stand 32 (refer to FIG. 3). The disposing stand 532 is supported movably in the up-down direction, by means of a rail 539 fixed on the inside of the case 5 (refer to FIG. 2). The disposing section 34 of the disposing stand 532 contacts the peel-off tape of the laminated tape 24 from the left. The disposing stand 532 includes the first contact part 37 and the second contact part 38. The first contact part 37 is positioned on an upper side of the disposing section 34 and at the same position as the disposing section 34 in relation to the left-right direction. The second contact part 38 is positioned upwards and leftwards with respect to the first contact part 37. The disposing stand 532 is movable in the up-down direction between the first position (refer to FIG. 12) and the second position (illustration of which is omitted). When the disposing stand 532 is in the first position, the first contact part 37 faces the projecting section 58 in the left-right direction. When the disposing stand 532 is in the second position, the second contact part 38 faces the projecting section 58 in the left-right direction. The second position is a position more downward than the first position.

When the disposing stand 532 is in the first position (refer to FIG. 12), the projecting section 58 contacts the first contact part 37, whereby the cutting blade 46 is held in the partial cut position. On the other hand, when the disposing stand 532 is in the second position (illustration of which is omitted), the projecting section 58 contacts the second contact part 38, whereby the cutting blade 46 is held in the full cut position.

What is claimed is:

1. A printing apparatus comprising:

a conveying unit configured to convey a printing medium in a first direction;

a printing unit configured to execute printing on the printing medium conveyed by the conveying unit;

a disposing stand provided on a downstream side of the printing unit in the first direction, the disposing stand having a disposing section where the printing medium is disposed; and a cutting blade configured to cut the printing medium disposed in the disposing section, wherein the disposing stand is movable between a first position and a second position different from the first position, in a third direction orthogonal to the first direction and orthogonal to a second direction, the second direction being a thickness direction of the printing medium that is disposed in the disposing section.

2. The printing apparatus according to claim 1, further comprising a supporting member configured to support the cutting blade movably from a non-cutting position, via a partial cut position, to a full cut position, the non-cutting position being a position at which a blade edge is separated from the printing medium disposed in the disposing section, the partial cut position being a position at which the cutting blade cuts a part of the printing medium in the second direction, the full cut position being a position at which the blade edge passes beyond the disposing section to fully cut the printing medium in the second direction.

3. The printing apparatus according to claim 2, wherein the disposing stand further comprises a first contact part different from the disposing section, and in a state that the disposing stand is in the first position, the first contact part makes contact with the supporting member or another part of the cutting blade which is different from the blade edge, and thereby holding the cutting blade in the partial cut position.

4. The printing apparatus according to claim 3, wherein in a state that the disposing stand is in the second position, the first contact part allows the cutting blade to be positioned in the full cut position, without making contact with the supporting member nor the cutting blade.

5. The printing apparatus according to claim 4, wherein the disposing stand further comprises a second contact part different from the first contact part, and in a state that the disposing stand is in the second position, the second contact part makes contact with the supporting member or the another part of the cutting blade which is different from the blade edge, and thereby holding the cutting blade in the full cut position.

6. The printing apparatus according to claim 3, wherein a part of the supporting member is a projecting section projecting from the blade edge and configured to make contact with the first contact part.

7. The printing apparatus according to claim 3, wherein the disposing section has a groove in which the blade edge of the cutting blade in the full cut position enters.

8. The printing apparatus according to claim 7, wherein a width of the groove in the first direction is shorter than five times a width of the cutting blade in the first direction.

9. The printing apparatus according to claim 3, wherein the disposing section includes a member which is softer than the blade edge.

10. The printing apparatus according to claim 3, wherein the supporting member is pivotable around a pivot shaft extending in the first direction, in the partial cut position, a direction in which the blade edge of the cutting blade extends is orthogonal to the second direction, and in the full cut position, the direction in which the blade edge of the cutting blade extends is not orthogonal to the second direction.

* * * * *